US009168760B2

(12) United States Patent
Li

(10) Patent No.: US 9,168,760 B2
(45) Date of Patent: Oct. 27, 2015

(54) METHOD OF CREATING AN IMAGE ON A STONE SUBSTRATE SURFACE AND RESULTING PRODUCT

(71) Applicant: Tong Li, Lansing, MI (US)

(72) Inventor: Tong Li, Lansing, MI (US)

( * ) Notice: Subject to any disclaimer, the term of this patent is extended or adjusted under 35 U.S.C. 154(b) by 401 days.

(21) Appl. No.: 13/757,122

(22) Filed: Feb. 1, 2013

(65) Prior Publication Data

US 2014/0218457 A1 Aug. 7, 2014

(51) Int. Cl.
*B41M 5/26* (2006.01)
*B41J 2/32* (2006.01)

(52) U.S. Cl.
CPC .. *B41J 2/32* (2013.01); *B41M 5/262* (2013.01)

(58) Field of Classification Search
CPC ..... B32B 3/26; B05D 3/06; B41J 2/32; B41M 5/262
See application file for complete search history.

(56) References Cited

U.S. PATENT DOCUMENTS

| | | | | |
|---|---|---|---|---|
| 4,732,410 | A * | 3/1988 | Holbein et al. | 347/172 |
| 5,341,157 | A | 8/1994 | Campagna et al. | |
| 5,381,591 | A * | 1/1995 | Ponger et al. | 27/35 |
| 5,554,335 | A | 9/1996 | Fields et al. | |
| 6,037,015 | A | 3/2000 | dos Santo Simoes et al. | |
| 6,064,034 | A | 5/2000 | Rieck | |
| 6,169,266 | B1 * | 1/2001 | Hughes | 219/121.68 |
| 6,462,303 | B1 * | 10/2002 | Brown | 219/121.69 |
| 6,746,724 | B1 * | 6/2004 | Robertson et al. | 219/121.69 |
| 7,351,783 | B1 * | 4/2008 | Perala et al. | 528/27 |
| 7,919,191 | B2 | 4/2011 | Arnold | |
| 2001/0031315 | A1 * | 10/2001 | Okamoto et al. | 427/372.2 |
| 2006/0234061 | A1 * | 10/2006 | Buckel et al. | 428/412 |
| 2007/0099699 | A1 * | 5/2007 | Plotkin | 463/30 |
| 2008/0160254 | A1 * | 7/2008 | Arnold | 428/141 |

* cited by examiner

*Primary Examiner* — Geoffrey S Evans
(74) *Attorney, Agent, or Firm* — Young Basile Hanlon & MacFarlane

(57) ABSTRACT

A method of creating images in stone substrate such as granite monuments using digital laser etching into a painted area. Alternatively, two layers of color contrasting coatings may be applied and the laser etching penetrates into the innermost layer to produce a contrast with the top coat. Pigmented material of a chemical content which is related to the mineral content of the substrate. Various enhancement techniques are also described.

6 Claims, 10 Drawing Sheets

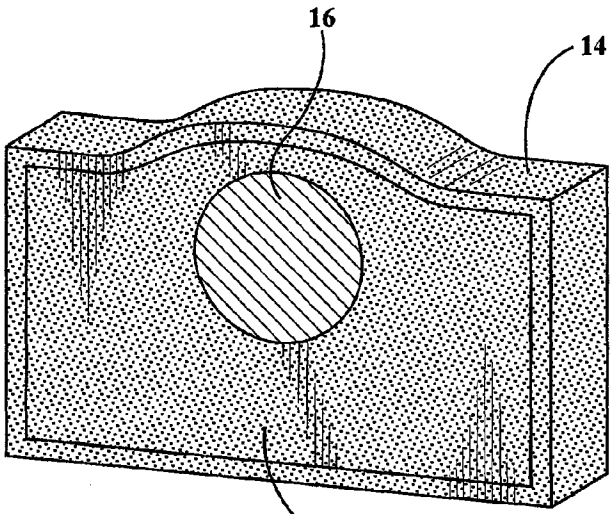
FIG. 3
FIG. 2
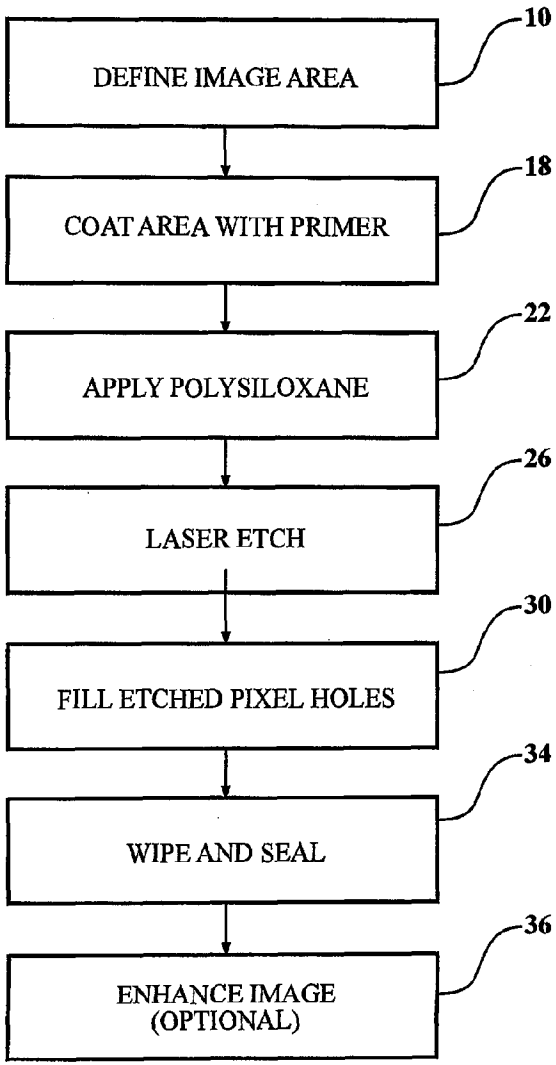

METHOD OF CREATING AN IMAGE ON A STONE SUBSTRATE SURFACE AND RESULTING PRODUCT

FIELD OF THE INVENTION

The invention relates to a method of producing high contrast images on stone or stone-like substrates of known mineral content wherein the method includes steps of laser etching and painting.

BACKGROUND OF THE INVENTION

It is known to create lettering, numbering and simple carvings in stone surfaces, most particularly in burial headstones and monuments, by sandblasting or cutting into a stone surface to form lines and curves of removed material. A sandblasting process is typically carried out with the use of a rubber stencil, limiting the process to relatively thick lines and large letters or numbers.

Some years ago, the use of lasers appeared in the monument industry but was typically limited to performing on dark granites. More recently, U.S. Pat. No. 7,919,191 was issued to George M. Arnold describing a method of creating pigmented images on stone such as granite. The Arnold method includes the steps of masking the stone substrate in an image area burning through the mask to pit the stone substrate, applying pigmented paint over the image area and thereafter removing the remains of the mask. Lithochrome paint is applied as base paint and also pigmented paint. Lithochrome paint is acrylic-based surface bonding paint. During freeze and thaw weathering cycles, it blisters easily and therefore, can separate from the granite surface.

SUMMARY OF THE INVENTION

The present invention provides for the creation of high contrast images on the surface of objects made of stone, such as granite, of known molecular content by combinations of steps involving painting and laser etching. The process is not limited to performance of the more expensive dark-colored granites, nor does it require the use of lasers to burn through stencils or masks in the critical steps of the image creation process. Also the combined coating and image pigments are all rooted into the micro structure of the stone with molecular bonding to the minerals through chemical reaction. The color rooting technique through chemical reaction into mineral structure will enable the image to withstand longer and more severe weathering. The UV protection quality of the hybrid organic and inorganic polysiloxane paint and inorganic silicate mineral paint combination will allow the image to withstand a long-lasting UV exposure.

In general, the process of the present invention comprises the steps of defining an image area on a surface of a suitable substrate. In the case of polished granite, this involves removing the effects of polishing. Thereafter, the area is processed in such a way as to create a two-color image similar to a black and white photograph, wherein the image is defined by extremely small pixels which are either of a relatively light color or are a relatively dark color. The color selection being made by a digitally-controlled laser etching. In this fashion, a high contrast image is created. The image area can then be sealed for weather protection.

According to a first embodiment, the contrasting colors are created by the steps of (a) priming the substrate, (b) applying a first color to the image area, (c) laser etching the image through the area of first color, and (d) filling the laser-etched holes with a second contrasting color.

According to a second embodiment of the method invention, the image area of the substrate is (a) re-colored by a mix of primer and underlayer color, then (b) overcoated with a second contrasting color, and then (c) laser-etched through the second color layer to reveal pixel areas of the underlayer.

In both cases, the resulting product is a substrate that exhibits a two-color image wherein one color is produced by a full-area layer of coating material and the contrasting color appears in pixel areas created by digital laser etching, according to the light and dark areas of an image model such as a digital camera record or actual photo.

In the first process, the priming step involves impregnating, for example, granite with a breathable primer, such as Silane, having a chemical content that matches the mineral content of the granite, forming a chemical bond of Si—O and O—Si between the mineral compound (in granite, they are mica, quartz and feldspar). Thereafter, the primed area is coated with a first pigmented paint also having a chemical content matching the content of the substrate and the primer. Thereafter, using known photo-processing methods, a digital image is laser-etched into the overcoated area by creating a pattern of pixelated holes through the rooted overcoating paint and to or into the primer. Thereafter, the blind laser-etched holes are filled with a second pigmented paint which contrasts with the first pigmented paint. The next step may be carried out by overcoating the entire area with a water-based paint that fills the holes, and thereafter scrubbing off the excess paint from the surface of the image area, leaving only the filled blind holes with the second pigmented paint therein. The rooted overcoat paint is hydrophobic and not a solvent-based pigmented paint (such as silicate mineral paint, or water-based outdoor or marine paint) and will only stay inside the laser-etched holes, not on the overcoat.

The method may be further enhanced by sealing the image area for durability and/or altering the appearance of an area around a principal portion of the image, such as the clear coat of polysiloxane paint for weather and UV durability.

The second embodiment described above uses the same materials but differs mainly in the elimination of the need to fill the laser-etched holes after they are made.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter being briefly described hereinafter.

BRIEF SUMMARY OF THE DRAWINGS

The description herein makes reference to the accompanying drawings wherein like reference numerals refer to like parts throughout the several views and wherein:

FIG. 2 is a block diagram of a method for carrying out the invention;

FIG. 3 is a perspective view of a granite substrate which has been cut to desired size and shape and in which an area for an image has been sandblasted or ground with a diamond wheel to define a desired image area;

DETAILED DESCRIPTION OF THE ILLUSTRATIVE EMBODIMENT

Figure 1:
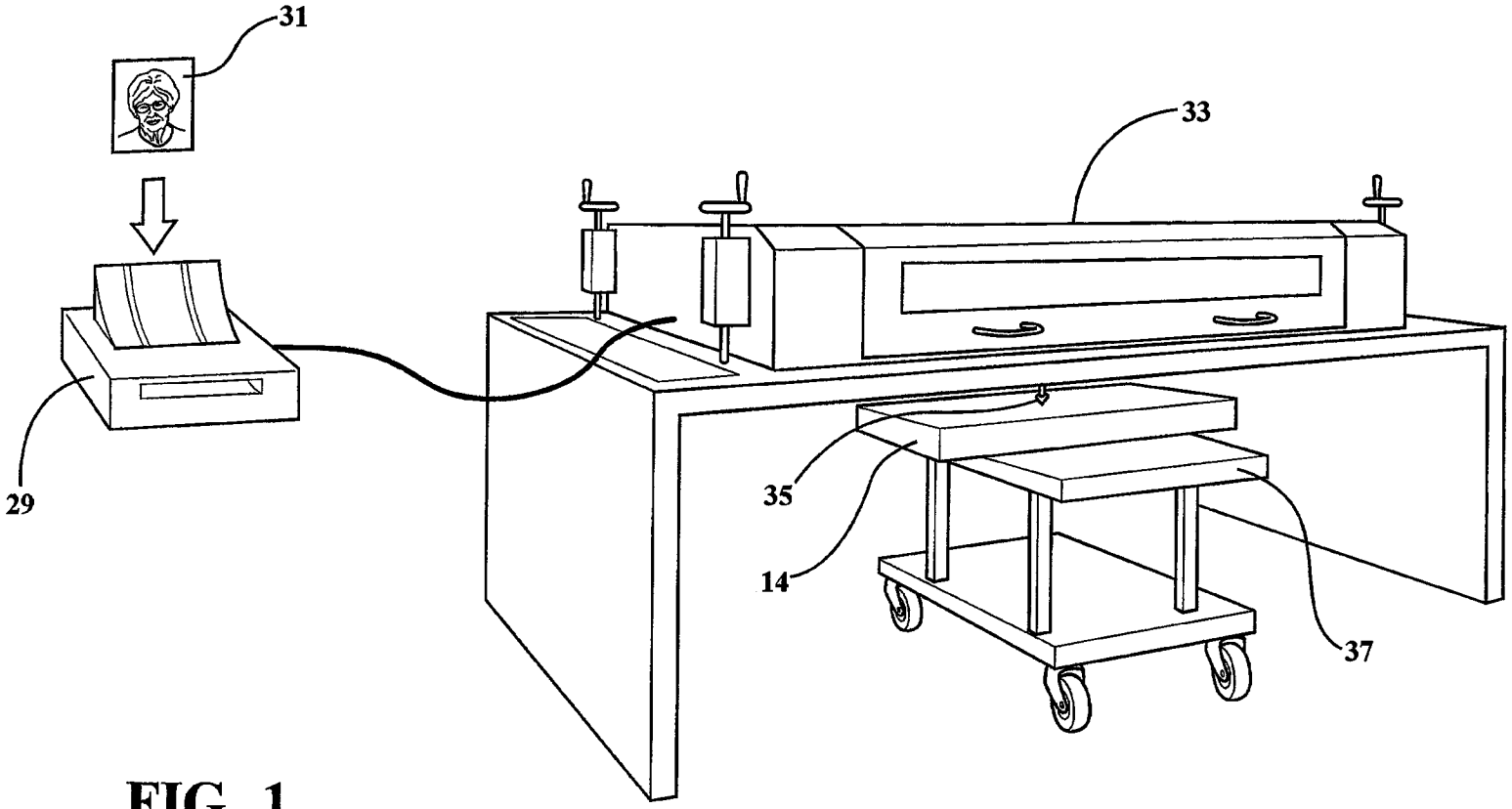
FIG. 1 shows a system for carrying out the invention.
Figure 4:
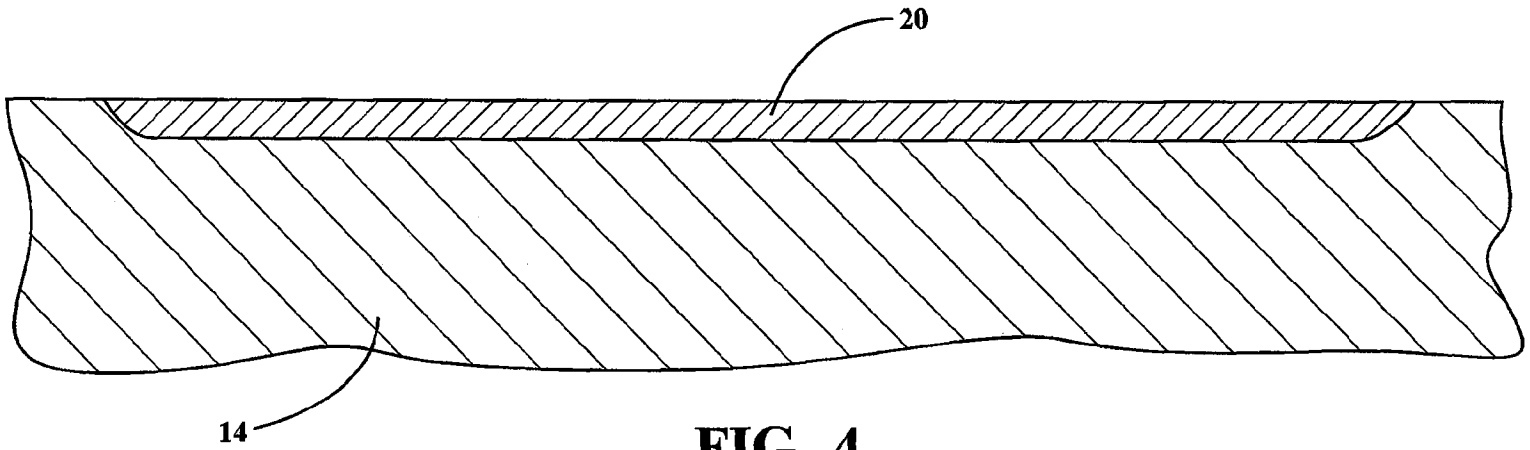
FIG. 4 is a sectional view of the substrate of FIG. 2 after a priming step.
Figure 5:
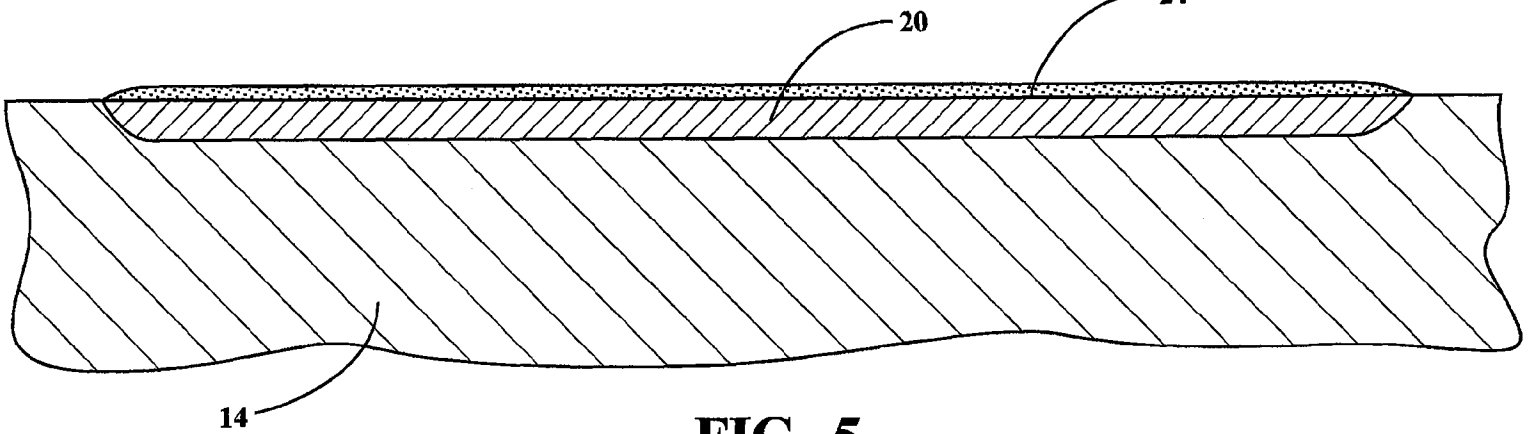
FIG. 5 is a side view of the substrate of FIG. 4 after a first painting step.

Referring first to FIG. 1, there is shown an apparatus comprising a photoprocessor 29 capable of receiving and electronically processing a digital image from a source 31 such as a Secure Digital (SD) card or a printed black and white photograph. The image may be produced by a digital camera in conventional fashion or by scanning a photograph or other two-dimensional image.

The apparatus further comprises a laser controller 33 having a laser gun 35, the position coordinates of which can be controlled in a line-by-line scanning fashion over the face of a stone substrate 14 mounted on a table 37 under the gun 35. Resolution of the laser system is 100-1000 pixels per inch, if the laser system is set to 300 pixels per inch, which means the laser 35 can be fired every $1/300^{th}$ of an inch as it moves across the surface of the stone substrate 14. The movements of the gun 35 are controlled by the digital content of the image 31 as electronically interpreted by processor 29.

Referring to FIGS. 2-9, a first method will be described. The first step 10 of the method is to select a substrate, such as a granite monument 14 of known mineral content and having a surface 12 suitable for laser etching. Normally, this is a flat, polished surface on the face of the stone monument 14. Step 10 further involves defining an area 16 within the surface 12 where an image of the desired size can be located. In this case, the face 12 is approximately 2 feet by 3 feet, is flat and has been polished by known methods using known materials to produce a glossy, smooth, marble-like finish on the surface 12. The defined area 16 is treated by sandblasting or grinding with a diamond wheel to eliminate the glassy smoothness of the polishing process in a circular area 16 where an image is to be placed. It will be understood that if the surface 12 has not been polished, the defining step is simply one of establishing the physical location, shape and size of the area 16 into which an image is to be placed.

It is important to note that several of the following steps described hereinafter are dependent on knowing the mineral content of the monument 14. In this case, the monument is granite. It is well known that granite is an abundant rock or mineral containing, in various percentages, the elements of quartz, feldspar and mica. Quartz is a hard white or colorless mineral consisting of silicon dioxide. Feldspar is an abundant rock-forming mineral consisting of colorless or pale crystals of aluminosilicates but can also contain potassium, sodium; calcium or barium. Mica is a shiny silicate mineral with a layered structure found in granite and various other rocks. The two most important common elements of granite, therefore, are silicon and oxygen, both of which are found in all of the constituents of granite named above.

The second step 18 is carried out by coating the image area 16 with a Silane primer 20. Because Silane contains silicon and oxygen and therefore has a chemical content which is directly related to the mineral content of the granite substrate, the primer 20 soaks into and bonds molecularly to the granite to produce a waterproof, but air and water permeable layer shown in FIG. 4. The primer is clear and colorless. The step 18 can be carried out by spraying or brushing. A small percent of the polysiloxane paint (same coating used in step 22, but can be with a different color) can also be added to either lighten or darken the grain of the granite color and providing anchors (roots) for the next layer of overcoat. A contrasting color is therefore rooted into the grain and mineral structure of the granite.

The next step 22 is to overcoat the primed area 20 with a polysiloxane paint 24 of a first color. In this case, the color is black but may be any color that contrasts with the color of paint to be applied in step 30. Again, the polysiloxane paint has a chemical content including elements of the granite substrate as well as the chemical content of the primer and therefore bonds to both molecularly. The paint 24 is waterproof and non-breathable. The surface then is wiped out of the excess paint with a towel or rubber squeegee such that all of the paint is ingrained into the pores and mineral structure of the granite, changing the granite color, in this case, black, but keeping the granite grain visible. If the color is not dark enough, then perform the same process after the first layer of ingrained paint reaches the recoating curing stage.

The next step 26 is to use the apparatus of FIG. 2 to etch an image into and through the painted area 24 in a pixelated; i.e., digital, fashion.

Figure 6:
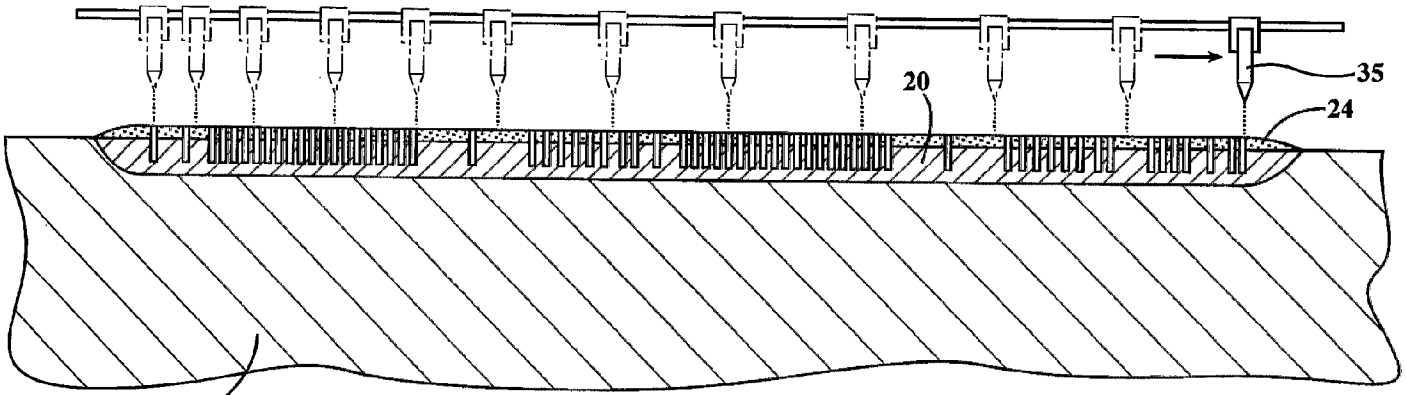
FIG. 6 is a sectional view of the substrate of FIG. 5 after a laser etching or pixilation step.

As indicated above, laser 35 is driven by known machine elements across the image area incrementally and line-by-line, and causes the laser to either fire or not fire depending on whether the image pixel being read by processor 29 is photometrically seen as light or dark. If it is light, a microhole is burned through the paint 24 and to or into the primer 20. If the image pixel is dark, the laser does not fire and creates no hole. This continues, pixel by pixel until the entire image 31 has been scanned and turned into a "binary" image in the monument area 16. The holes are shown in FIG. 6.

At this point, only a small amount of contrast for the image is created, the actual degree of contrast being a function of the colors of the stone and the paint 24. If a light granite is used, and the paint 24 is black, image contrast is fairly great. All of the holes which are created by the laser are of the same depth and the spacing between them both in rows and columns is a function of the two-dimensional content of the image being copied.

A suitable laser etching machine is the AP Lazer available from AP Lazer; contact www.aplazer.com or aplazer@aplazer.com or call, toll free, 800-449-2481. The machines are available in various sizes and price ranges and are further described in U.S. Pat. No. 8,309,881, the entire disclosure of which is incorporated herein by reference.

Figure 7:
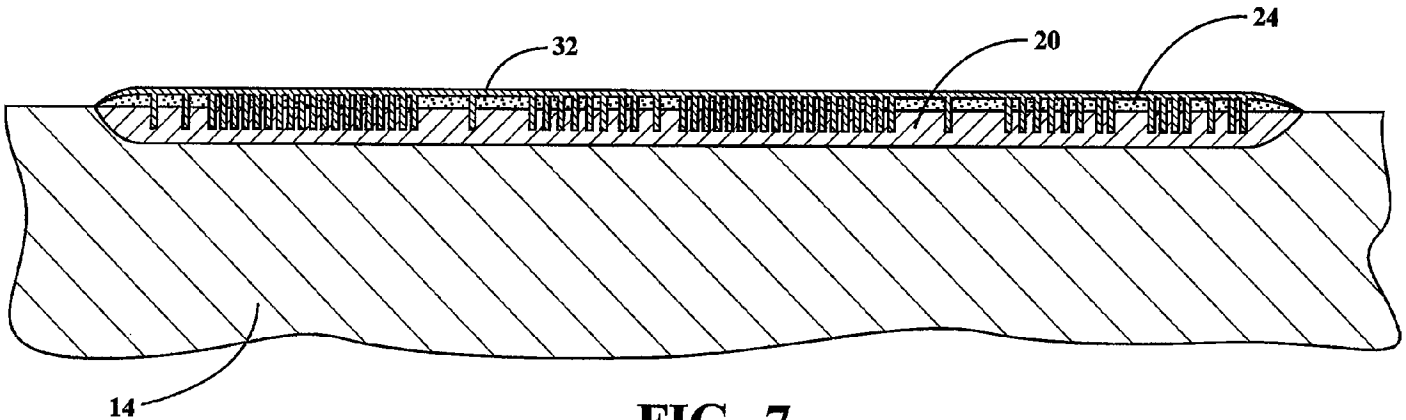
FIG. 7 is a sectional view of the substrate of FIG. 6 after a second painting step.
Figure 8:
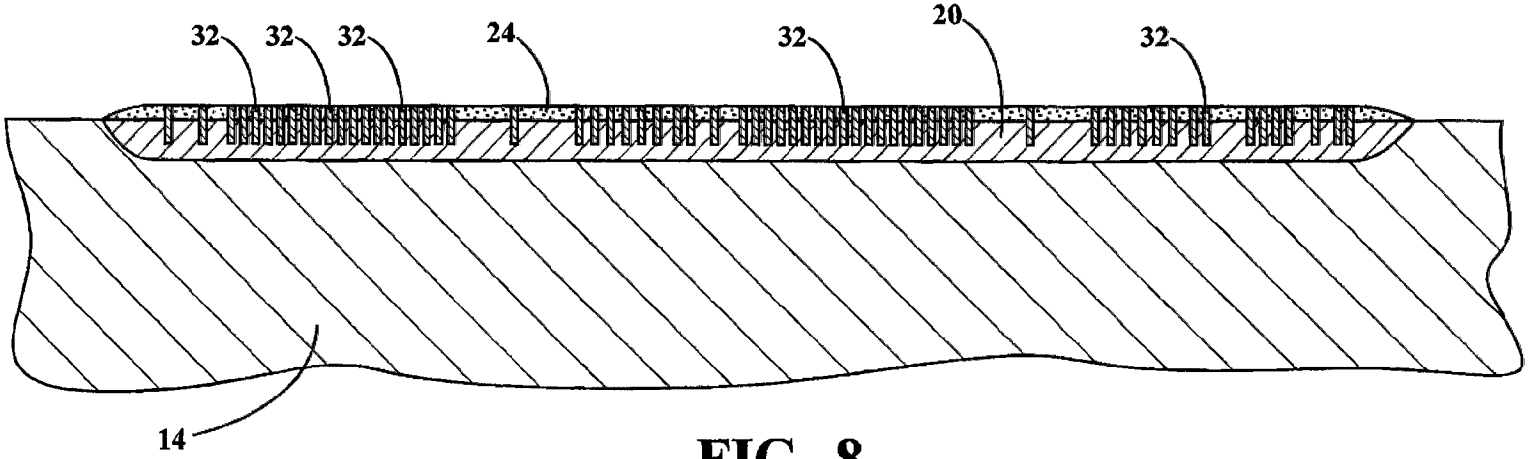
FIG. 8 is a perspective view of the substrate after the removal of excess paint.
Figure 9:
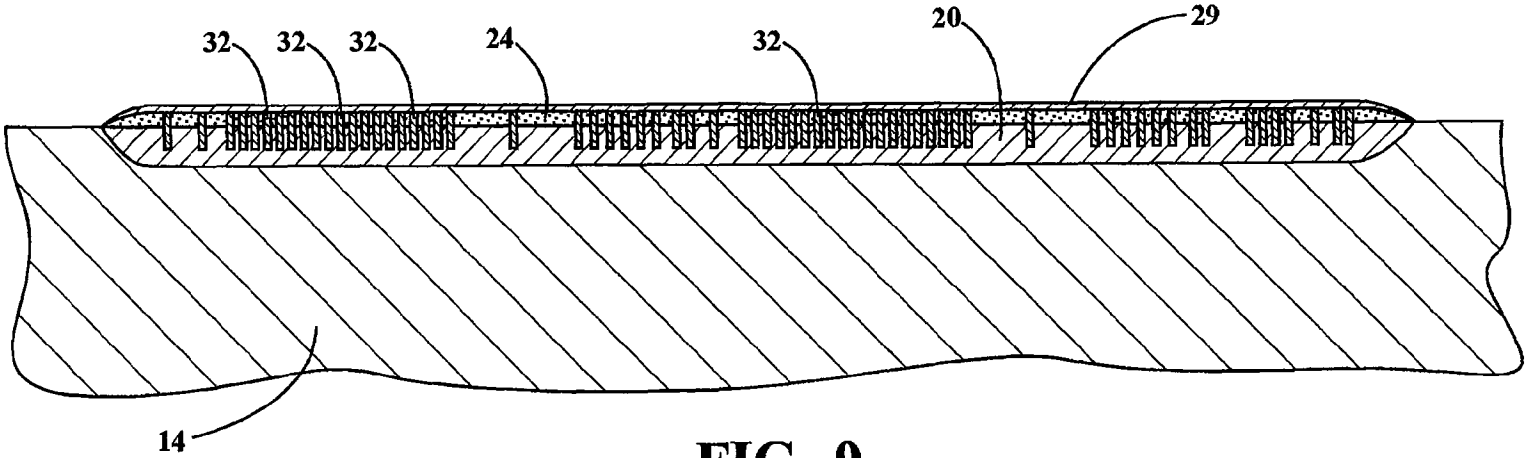
FIG. 9 is a perspective view of a sealed substrate on which an image has been created.
Figure 10:
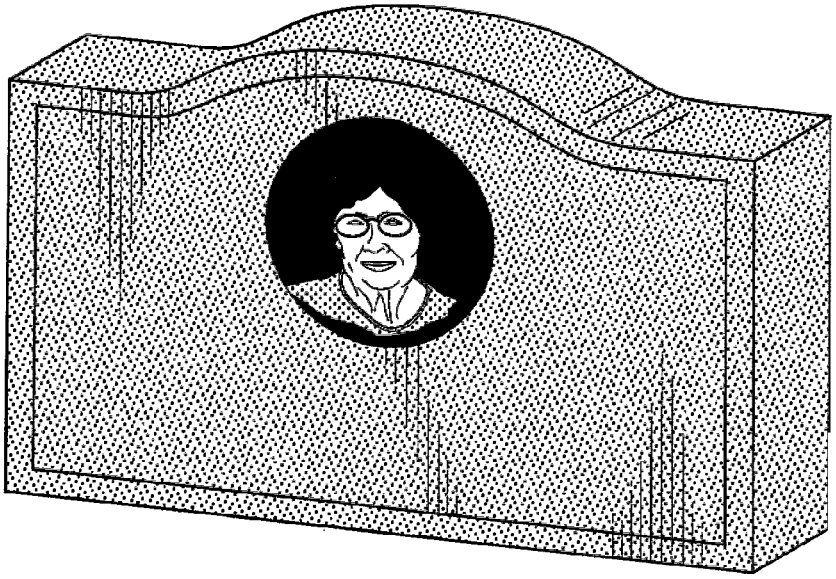
FIG. 10 is a perspective view of a substrate showing the final image.

The next step 30 is to bring up the contrast in the etched image as shown in FIG. 7. This is done by overcoating the etched image area with a second pigmented paint 32, preferably a silicate mineral paint in white, which provides a strong contrast with the previously applied paint 24 but is water based. The paint 32 may provide silicon and oxygen in the form of either sodium silicate or potassium silicate, thereby to create a strong molecular bond with the underlying paint and/or primer surfaces. However, because the paint is water based, the excess over the surface surrounding the etched holes is easily removed by a damp cloth as indicated in step 34 to leave a white paint only in the holes as shown in FIG. 8. The final step may be that of simply sealing the image area with a clear polysiloxane overcoating 29 for durability and weather protection. This is shown in FIG. 9. The resulting high contrast image is shown in FIG. 10. Dark details are created by paint 24 whereas light details are created by the white paint 32 in the holes created by the laser 35.

Figure 11:
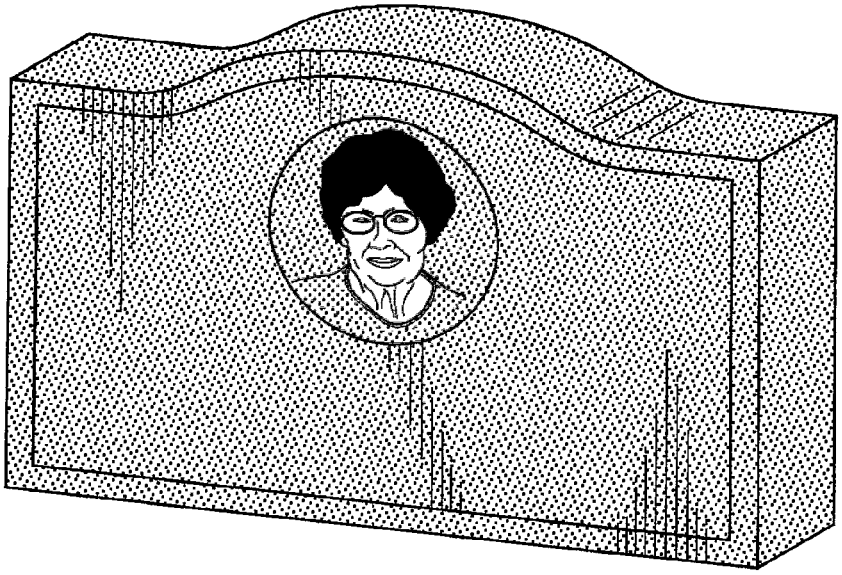
FIG. 11 is a view of the monument of FIG. 10 after optional enhancement.

A further enhancement step 36 of the image area by any of several steps may be incorporated into the process. The process described above provides a black background to the image area as generally shown in FIG. 10. A first alternative is to provide a white background by etching into the area surrounding the head and shoulders of the character in the image area. This involves the photoprocessor 29 which, using known "photoshopping" techniques, turns the dark background of the image white. The laser reader 33 reads the revised image to see light pixels outside of the outside of the head and shoulders shown in FIG. 10 as a command to fire the laser 35 at every pixel coordinate in the area lying outside of the person's head and shoulders in the image. When all of the resulting holes are filled with white paint, the circular image background becomes white. A third alternative, shown in FIG. 11, is to remove all of the paint around the outline of the head and shoulders of the figure as just described, but to fill the background holes with a clear sealer, leaving only the head and shoulders of the person who, in this case, constitutes the major component of the etched image, in black and white. This is feasible where the granite is light in color. In all cases, the final product is weather protected by a polysiloxane sealer.

It is to be understood that the entire black/white process described above can be reversed; i.e., the paint applied in step 22 can be white while the paint applied in step 30 is black. It is also to be understood that "black" and "white" are proxies for "dark" and "light", defined by any two contrasting colors. If the original image is in color, it can be converted to a grey-scale "bitmap" file and then converting that to black and white.

Figure 16:
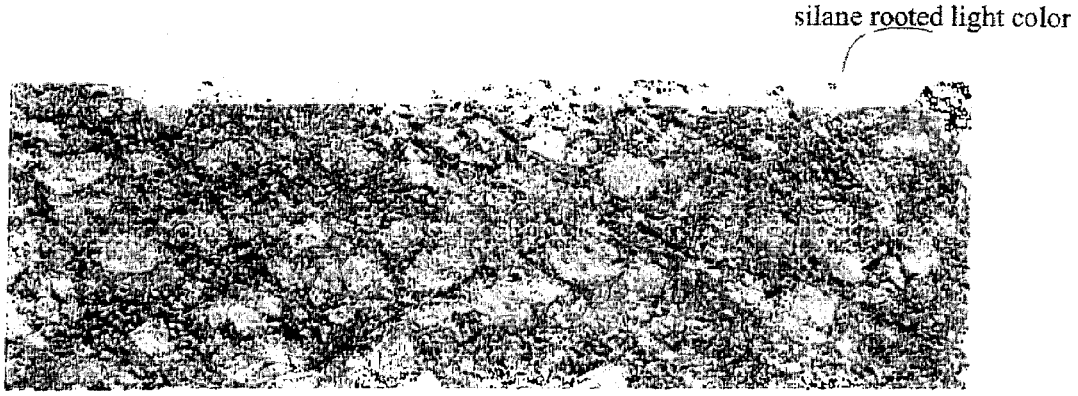
FIG. 16 is a photograph of a section of dark granite impregnated with a light-colored mix of Silane primer and paint.
Figure 17:
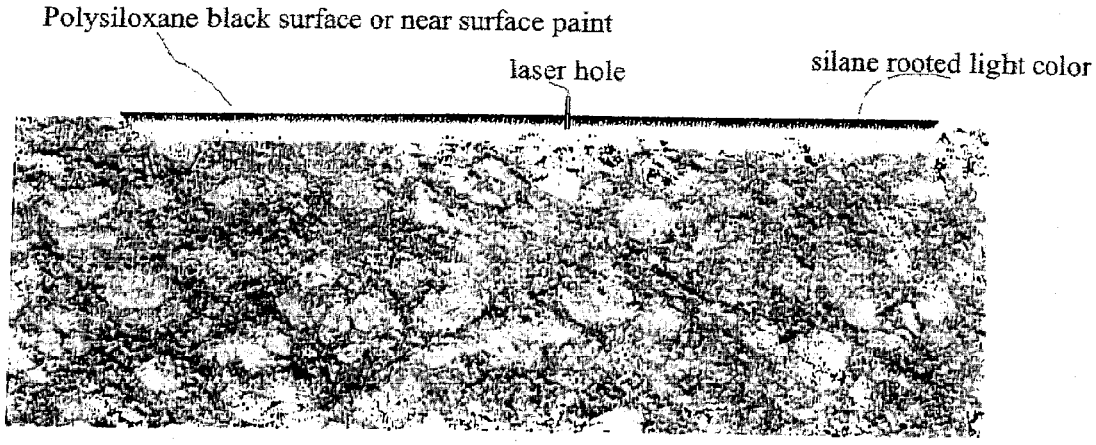
FIG. 17 is a section of the same granite overcoating with a dark paint and laser etching.

Referring to FIGS. 16 and 17, a second embodiment of the invention proceeds as follows. First, an image area is selected and processed as in step 10. Second, a Silane primer mixed with a polysiloxane paint of a first color, e.g., white, is applied over the image area. This combination penetrates into the pores, micro-fractures and gaps of the granite effectively changing its color from dark to light in the image area. Next, a coating of black polysiloxane paint is applied over the image area. Next, laser etching is done as in step 26 but the holes penetrate into the white layer, eliminating the need to fill the laser-etched holes with paint. The final step is one of sealing. If the granite is dark colored, the colors are applied in the opposite order; i.e., the primer is used with a dark polysiloxane paint and the overcoat; i.e., the topmost layer, in white. The terms "black" and "white" are not intended to be limiting as any two contrasting colors can be used.

It can be seen that both method embodiments produce a monument with a two-color, high contrast image created by laser etching to reveal a pixel-based color pattern against a background of a contrasting color which is left unetched.

Figure 12:
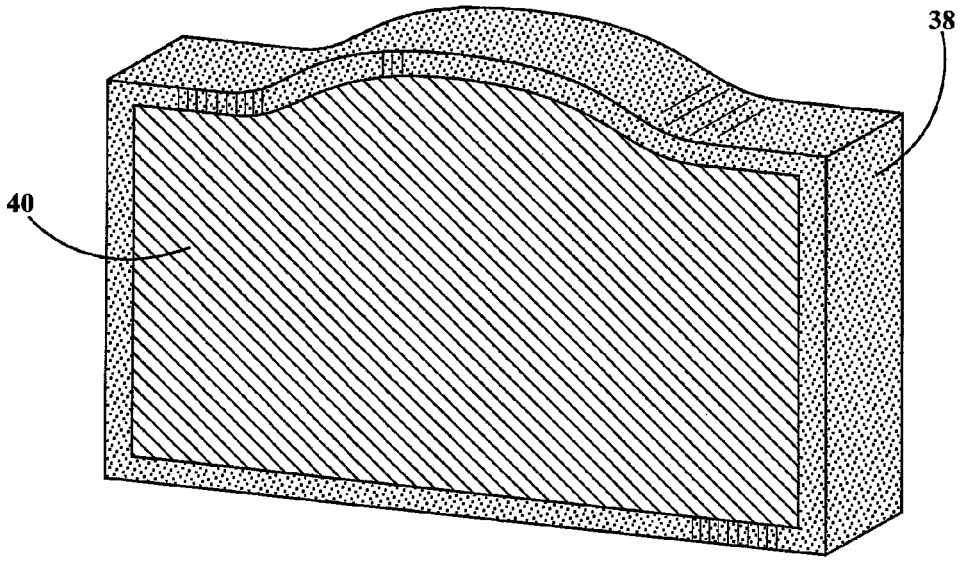
FIG. 12 is a perspective view of another monument after preparing the surface.
Figure 13:
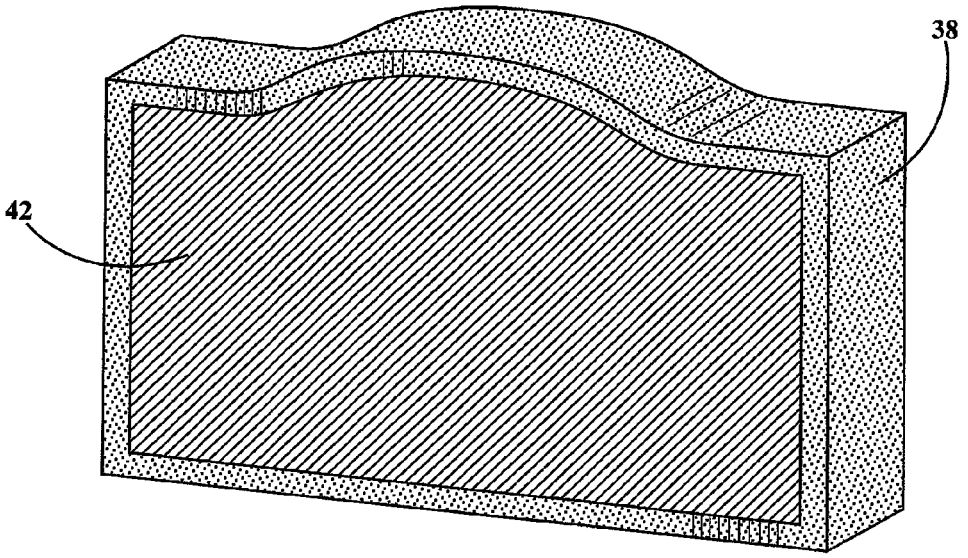
FIG. 13 is a perspective view of the monument of FIG. 12 after priming.

Referring now to FIGS. 12-15, the method is shown as applied to a substantially larger surface area 40 of a pre-cut and polished granite monument 38. The area 40 is prepared for the image transfer process by diamond grinding using a 100 grit abrasive as shown in FIG. 12. Thereafter, the prepared surface area 40 is covered with a layer of silicate primer which, because of its chemical content, has a high adhesion strength to granite. This is shown at 42 in FIG. 13. This may be shipped as an intermediate product to a cemetery or headstone supplier.

Figure 14:
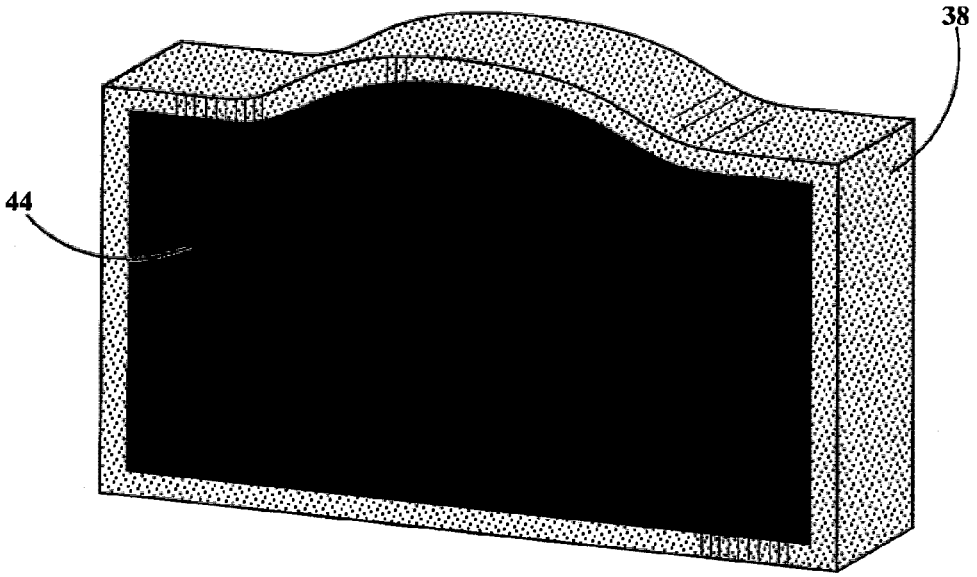
FIG. 14 is a perspective view of the monument of FIG. 12 after painting.
Figure 15:
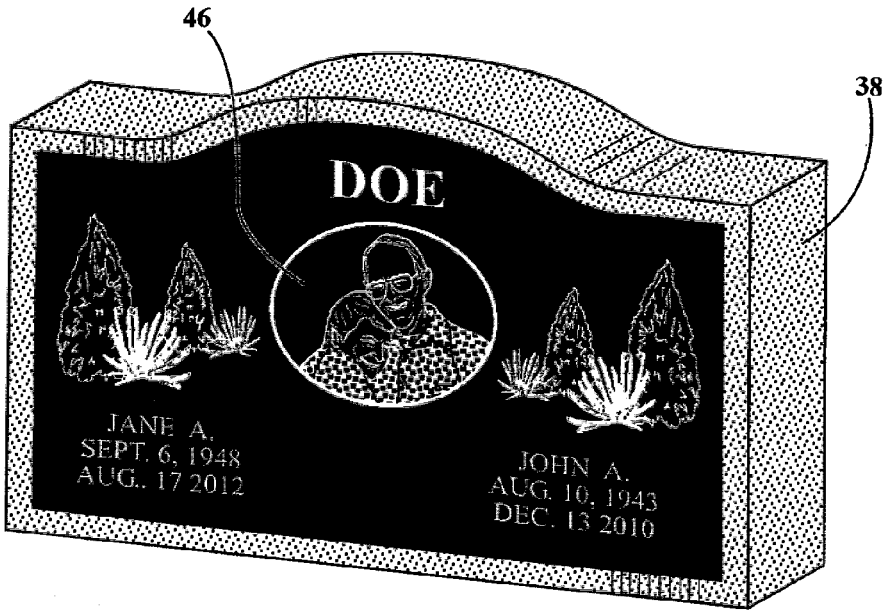
FIG. 15 is a view of a finished monument with a combination of laser etching and sandblasted work.

Thereafter, a layer 44 of dark color polysiloxane paint is applied over the primer layer 42 to generate a contrasting layer for laser etching as shown in FIG. 14. At this point, the laser etching of the surface using the laser etching machine previously described is carried out. The result is a pixelated area wherein the pixel holes are, as previously described, filled with a contrasting mineral paint such as polysiloxane paint for high weather resistance. The letters and numbers in the representation of FIG. 15 can be formed by any standard prior art technique including sandblasting and laser etching and the entire area is sealed. If desired, a different background design can also be accomplished to remove all background dark paint and then using clear polysiloxane to bring up the polished granite look.

The same color rooting technique can also be used to change, modify or repair the apparent color of substrate, such as granite, changing a low-cost color of granite; e.g., gray, to high-priced black or red colored granite.

It is to be understood that the method of the present invention can be carried out on mineral monuments and other substrates other than granite but of known mineral content wherein the coating substances and paints of similar chemical content are available to provide the necessary durability and molecular bonding. Images to be applied are not limited to those of human beings but may be those of animals, trees, plants, flowers and other objects. Similarly, while the invention is most often applied to burial monuments and memorials, it can also be used in connection with historical markers, highway markers, boundary markers, estate entrances, etc.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A method of creating an engraved image on a surface of a stone substrate, the molecular content of which includes silicon and oxygen, comprising the steps of:

digitizing an image;

defining an image-receiving area on the surface of said substrate;

coating the image-receiving area on said surface with a breathable primer having a chemical content including silicon and oxygen compatible with the mineral content of the substrate;

overcoating the primed area with a first pigmented, durable polysiloxane paint of a first color and having a chemical content related to the mineral content of the substrate and the primer;

using the digitized image, laser etching an image into the overcoated area by creating a digital pattern of blind holes of uniform depth in the overcoating paint and into but not beyond the primer;

overcoating the etched area with a polysiloxane paint of a second color contrasting to the first color to fill said blind holes; and sealing the image area.

2. The method of claim 1 wherein the substrate is granite.

3. A stone monument having an engraved image on a surface thereof which is created by the method defined in claim 1.

4. A method of creating an engraved image on the surface of a stone substrate wherein the molecular composition of the stone contains components of silicon and oxygen and wherein the method comprises the steps of:

digitizing an image;

defining an image-receiving area on the surface of the substrate;

coating the image-receiving area with a primer having a chemical content including components of silicon and oxygen so as to be compatible with the substrate material;

applying a polysiloxane paint over the primer and having a first color;

applying a second polysiloxane paint over the first color layer and having a color which strongly contrasts with the color of the first polysiloxane paint;

using the digitized image, etching a digital pattern of holes of uniform depth through the second polysiloxane paint layer and into the first polysiloxane paint layer thereby to create a reproduction of the digitized image; and, thereafter, sealing the image area.

5. The method as defined in claim 4 wherein the first polysiloxane paint layer is white and the second polysiloxane paint layer is black.

6. A stone monument having an engraved image on a surface thereof which is created by the method defined in claim 4.

* * * * *